US009742100B2

(12) United States Patent
Fujikawa et al.

(10) Patent No.: US 9,742,100 B2
(45) Date of Patent: Aug. 22, 2017

(54) CONNECTOR

(71) Applicant: YAZAKI CORPORATION, Tokyo (JP)

(72) Inventors: Ryo Fujikawa, Shizuoka (JP); Takahiro Matsuo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/278,094

(22) Filed: Sep. 28, 2016

(65) Prior Publication Data

US 2017/0093080 A1 Mar. 30, 2017

(30) Foreign Application Priority Data

Sep. 29, 2015 (JP) ..... 2015-191093

(51) Int. Cl.
*H01R 13/40* (2006.01)
*H01R 13/52* (2006.01)
*H01R 13/426* (2006.01)

(52) U.S. Cl.
CPC ..... *H01R 13/521* (2013.01); *H01R 13/426* (2013.01)

(58) Field of Classification Search
CPC ..... H01R 13/521; H01R 13/426
USPC ..... 439/521
See application file for complete search history.

(56) References Cited

U.S. PATENT DOCUMENTS 5,410,105 A * 4/1995 Tahara ..... H01R 4/70 156/49
8,100,716 B2 * 1/2012 Yahya ..... H01R 13/5208 439/587
2010/0273353 A1 * 10/2010 Yahya ..... H01R 13/5208 439/587
2015/0333416 A1 * 11/2015 Kihara ..... H01R 4/20 439/877

FOREIGN PATENT DOCUMENTS

JP 2014-078326 A 5/2014
JP 5546708 B1 * 7/2014 ..... H01R 4/20

* cited by examiner

*Primary Examiner* — Abdullah Riyami
*Assistant Examiner* — Nader Alhawamdeh
(74) *Attorney, Agent, or Firm* — Mots Law, PLLC

(57) ABSTRACT

A connector includes a mat seal in which lips are protruded from an inner circumferential surface of a wire insertion hole, and a terminal to which an electric wire is connected and which has a cylindrical body to be inserted a mating terminal. The terminal is accommodated in a position that passes through the wire insertion hole, and the electric wire is arranged in a press-fitted state in the wire insertion hole. When a curvature radius of an edge part of the cylindrical body that contacts to the inner circumferential surface of the wire insertion hole in a process of passing through the wire insertion hole is denoted by R1 and a compression ratio of the lip in the process of passing through the wire insertion hole is denoted by CR1, the curvature radius R1 is set based on a formula of difficulty of mat seal breakage =f(R1/CR1).

6 Claims, 10 Drawing Sheets

CONNECTOR

CROSS REFERENCE TO RELATED APPLICATION

The present application is based on, and claims priority from Japanese Patent Application No. 2015-191093, filed Sep. 29, 2015, the disclosure of which is hereby incorporated by reference herein in its entirety.

BACKGROUND

Technical Field

The present application relates to a connector having a waterproof property.

Related Art

As a conventional connector having a waterproof property, one is proposed which includes a connector housing, a sealing member mounted in the connector housing, and a terminal accommodated in a terminal housing of the connector housing. As illustrated in FIG. 9, in the conventional connector, wire insertion holes 55*a* are formed in a sealing member 55. Moreover, as illustrated in FIG. 10, a terminal 60 includes a mating terminal connecting section 61 that includes an elastic deformation part within a cylindrical body 62 and into which a mating terminal is inserted, and a wire connecting section 63 to which an electric wire is connected by crimping.

While FIG. 9 illustrates a position just before the terminal 60 with the electric wire passes through the sealing member 55, the terminal 60 with the electric wire is accommodated in the terminal housing of the connector housing (not illustrated) by passing through the wire insertion hole 55*a* of the sealing member 55. The electric wire connected to the terminal 60 is accommodated so as to adhere inside the wire insertion hole 55*a*. Thus, water or the like is prevented from entering into the terminal housing of the connector housing along the electric wire that is drawn outside from the connector housing (see Patent Literature 1 (JP 2014-078326 A)).

SUMMARY

Incidentally, when the terminal 60 passes through the wire insertion hole 55*a* of the sealing member 55 in a mounting process of the terminal 60 to the connector housing, the terminal 60 enters by stretching out the wire insertion hole 55*a*. Especially, corners 62*c* of the cylindrical body 62 of the terminal 60 apply external force to the scaling member 55 most to expand the wire insertion hole 55*a*.

Further, as illustrated in FIG. 10, at the terminal 60, the cylindrical body 62 is made into a cylindrical shape by bending a sheet of plate at a plurality of places, and since an end face 62*a* of the plate that extends in an insertion direction D to the sealing member 55 is located in the vicinity of the corner 62*c* of the cylindrical body 62, an edge of the end face 62*a* directly contacts the sealing member 55. The sealing member 55 becomes damaged (breakage damage) by the edge of the end face 62*a*.

Thus, in the conventional terminal 60, there is a high possibility that the sealing member 55 is damaged (breakage damaged) in a process of passing through the wire insertion hole 55*a* of the sealing member 55. The waterproof property becomes deteriorated when the scaling member 55 is damaged.

Accordingly, the present application was made to solve the above-described problem and it aims to provide a connector in which damage to the sealing member at the time when the terminal is penetrated can be securely prevented in a connector on which the terminal with the electric wire is mounted by penetrating in the wire insertion hole of a sealing member.

The connector according to an aspect of the present application includes a sealing member having a wire insertion hole, an inner circumferential surface of the wire insertion hole being provided with a lip that protrudes, and a terminal to which an electric wire is connected, the terminal having a cylindrical body to which a mating terminal is inserted. The terminal is accommodated in a position that passes through the wire insertion hole, and the electric wire is arranged in a press-fitted state in the wire insertion hole. In a process of the terminal passing through the wire insertion hole, when a curvature radius of an edge part of the cylindrical body that has a possibility of contacting the inner circumferential surface of the wire insertion hole is denoted by R1 and a compression ratio of the lip of the sealing member is denoted by CR1, the compression ratio CR1 and the curvature radius R1 are set based on a formula of difficulty of the sealing member breakage=f(R1/CR1).

According to the connector relating to the aspect of the present application, by setting the compression ratio CR1 and the curvature radius R1 to be values that do not damage (breakage damage) the sealing member in a process of the terminal penetration based on the formula of difficulty of the sealing member breakage=f(R1/CR1), it is possible to securely prevent damage (breakage damage) in a process of the terminal penetration through the wire insertion hole of the sealing member.

DETAILED DESCRIPTION

Hereinafter, a connector according to an embodiment will be explained based on FIGS. 1 to 8.

(Embodiment)

Figure 1A:
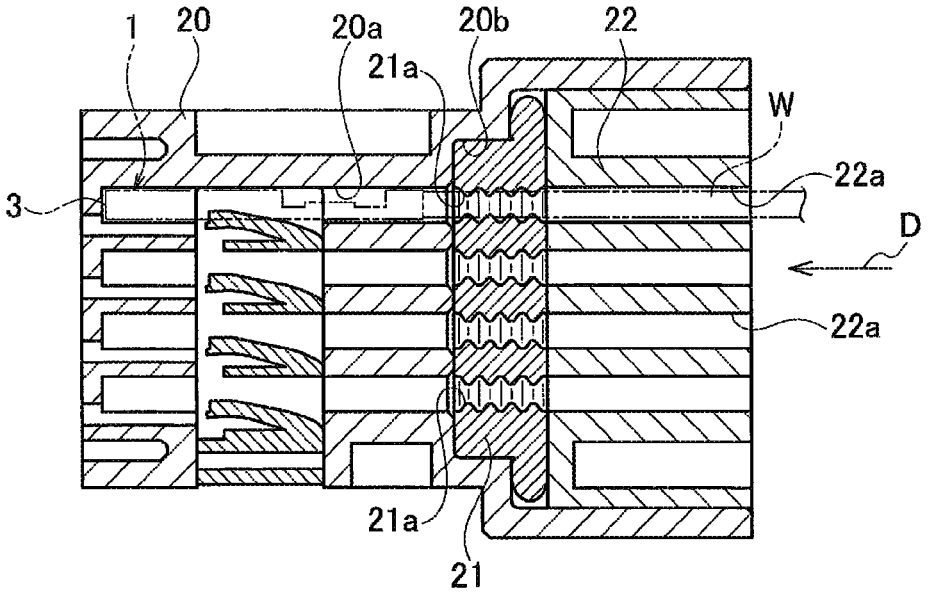
FIG. 1A is a cross-sectional view of a connector on the connector housing side according to an embodiment.

As illustrated in FIG. 1A, the connector according to the embodiment includes a connector housing 20, a mat seal 21 which is a sealing member accommodated in the connector housing 20, a rear holder 22 that holds the mat seal 21 at the rear of the mat seal 21, and one or more terminals 1 to each of which an electric wire W is connected, the terminals 1 being mounted in the connector housing.

A plurality of terminal housings 20*a* and a mat seal housing 20*b* arranged at the rear of these terminal housings 20*a* on the wire draw-out side are formed in the connector housing 20.

The mat seal 21 is accommodated in the mat seal housing 20*b*. The mat seal 21 is formed by a soft elastic material such as a rubber material or the like.

Figure 1B:
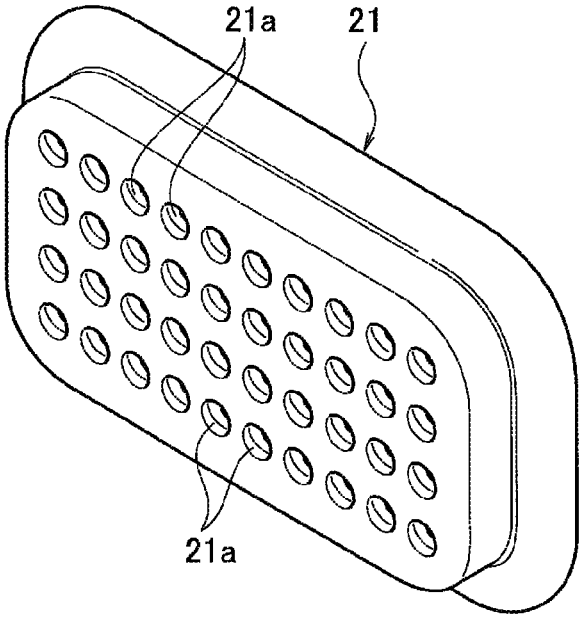
FIG. 1B is a perspective view of a sealing member of the connector according to the embodiment.

As illustrated in FIG. 1B, wire insertion holes 21*a* are respectively formed at positions that correspond to each of the terminal housings 20*a* in the mat seal 21. A plurality of lips 21*b* (see FIG. 3) are provided at intervals on the inner circumferential surface of each of the wire insertion holes 21*a* along the axial direction of the wire insertion holes 21*a*. Each lip 21*b* protrudes inward (toward the axial center) from the inner circumferential surface of the wire insertion hole 21*a*. Each lip 21*b* is mountain shaped whose tip has a circular are shape. Detailed explanations will be made regarding a curvature radius on the tip side of each lip 21*b* below. The inner diameter of each wire insertion hole 21*a* at the tip position of the lip 21*b* has a size that is smaller than the outer diameter of the electric wire W.

The rear holder 22 is arranged in the mat seal housing 20*b* from the rear face of the connector housing 20. In the rear holder 22, electric wire holes 22*a* are formed respectively at positions that correspond to electric wire insertion holes 21*a* of the mat seal 21. The inner diameter of each electric wire hole 22*a* has a size that is larger than the outer diameter of the terminal 1.

Figure 2A:
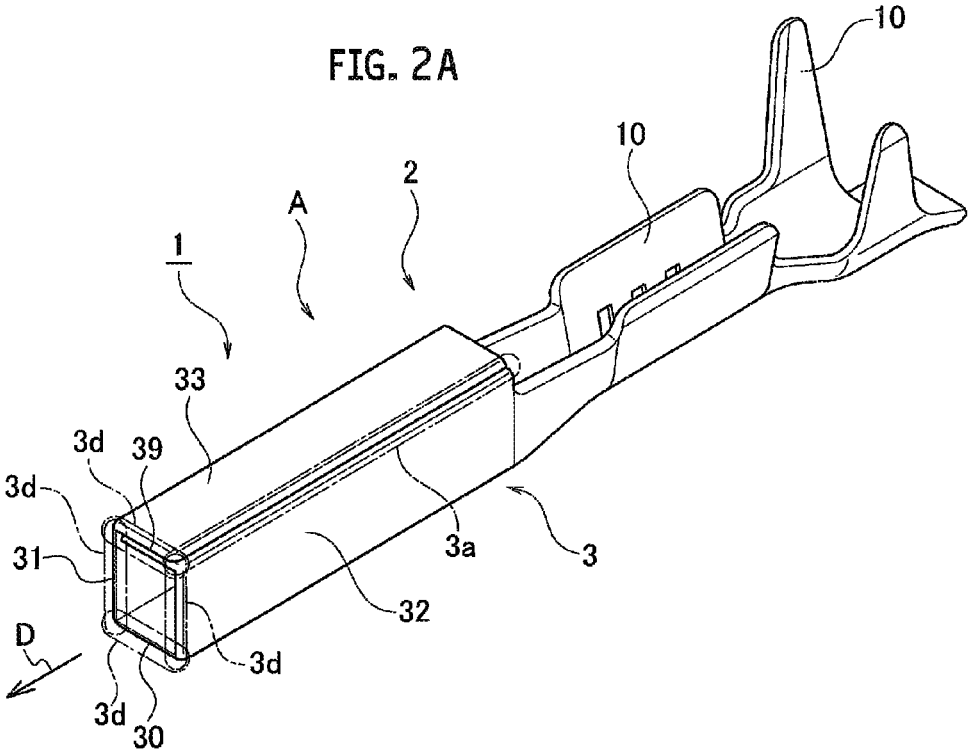
FIG. 2A is a perspective view of a terminal of the connector according to the embodiment.
Figure 2B:
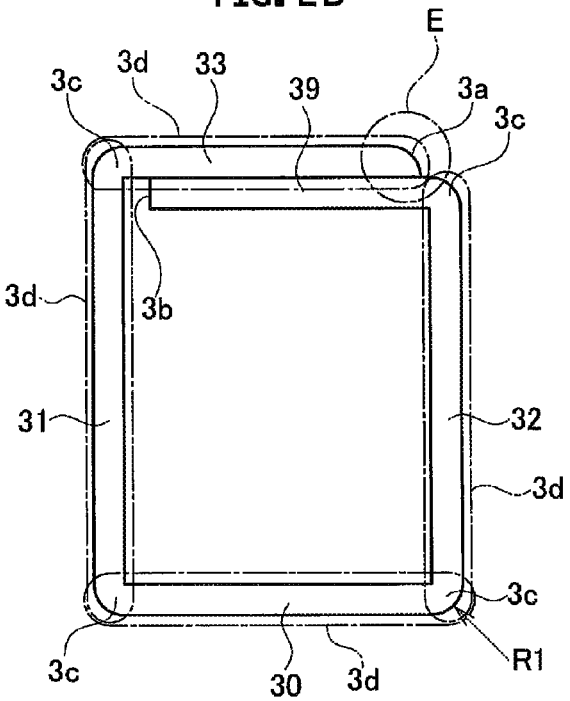
FIG. 2B is a front view of the terminal that is the insertion tip side to the sealing member of the connector according to the embodiment.
Figure 2C:
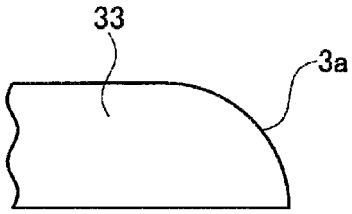
FIG. 2C is an enlarged view of the part as illustrated by a region E of FIG. 2B.

As illustrated in FIGS. 2A and 2B, the terminal 1 is formed by bending a sheet of conductive plate material that is formed in a predetermined shape. The terminal 1 includes a mating terminal connecting section 2 to which a mating terminal (not illustrated) is to be electrically connected, and an electric wire connecting section 10 to which the electric wire W is connected.

The mating terminal connecting section 2 includes a cylindrical body 3 having a rectangular shape and an elastic contact part (not illustrated) arranged within the cylindrical body 3. The cylindrical body 3 together with the elastic contact part is formed into a cylindrical shape by bending a sheet of plate material at a plurality of places.

More specifically, the cylindrical body 3 includes a bottom part 30, a pair of side parts 31, 32 that are bent from both ends of the bottom part 30 and extend in the vertical direction, and a pair of top parts 33, 39 that are bent from the upper end of each side part 31, 32 respectively. The pair of top parts 33, 39 are arranged so as to lie on top of one another. Tips of both top parts 33, 39 are end faces 3*a*, 3*b* of the sheet material that extends in the insertion direction (relative insertion direction with a mating terminal) D toward the mat seal 21.

The cylindrical body 3 is formed such that all the edge parts that are likely to contact the mat seal 21 in a process of passing through the wire insertion hole 21*a* of the mat seal 21 have curved surfaces. In the embodiment, the edge parts are the end face 3*a* of the plate material that extends in the insertion direction (relative insertion direction with a mating terminal) D toward the mat seal 21, an end face 3*d* that becomes the insertion tip toward the mat seal 21 of the cylindrical body 3, and corners 3*c* due to bending of the plate material (more specifically, their outer peripheral surfaces). While a curvature radius of the end face 3*a*, corners 3*c*, and the end face 3*d* as the edge parts will be described in detail below, for convenience of explanation, they will be explained as edge parts 3*a*, 3*c*, and 3*d*.

The curvature radius R1 of the edge parts 3*a*, 3*c*, and 3*d* of the cylindrical body 3 of the terminal 1 (in a case that the curvature radii differ depending on the location, in the following it will be the smallest curvature radius), the curvature radius R2 on the tip side of the lip 21*b*, and the compression ratios of the mat seal 21 (compression ratios CR1 and CR2 as indicated below) are set as follows.

When the curvature radius of the edge parts 3*a*, 3*c*, and 3*d* of the cylindrical body 3 that have a possibility of contacting the inner circumferential surface of the wire insertion hole 21*a* in a process of passing through the wire insertion hole 21*a* is denoted by R1, and the compression ratio of the lip 21*b* of the mat seal 21 in the process of passing through the wire insertion hole 21*a* (the state of FIG. 3A) is denoted by CR1, a formula (1) of the difficulty of the mat seat 21 breakage (breakage load)=f (R1/CR1) is established.

Figure 3A:
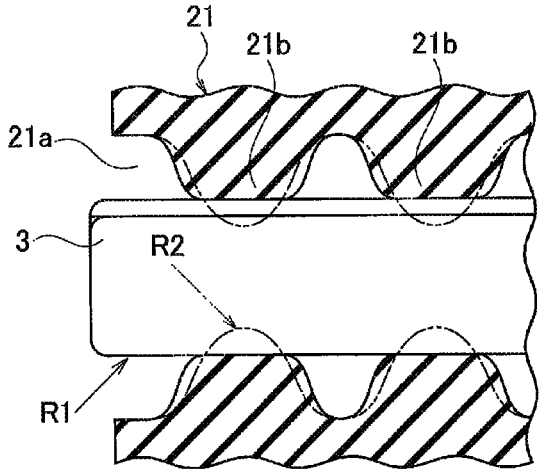
FIG. 3A is a cross-sectional view of a main part illustrating a penetrating process of the terminal through the sealing member of the connector according to the embodiment.
Figure 3B:
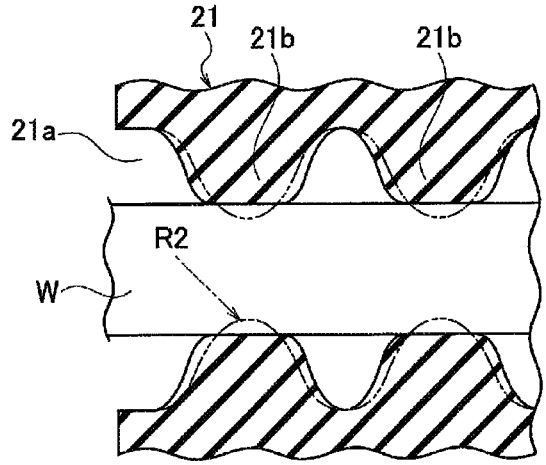
FIG. 3B is a cross-sectional view of the main part illustrating a state in which the electric wire is arranged in the wire insertion hole of the sealing member in the connector according to the embodiment.
Figure 3C:
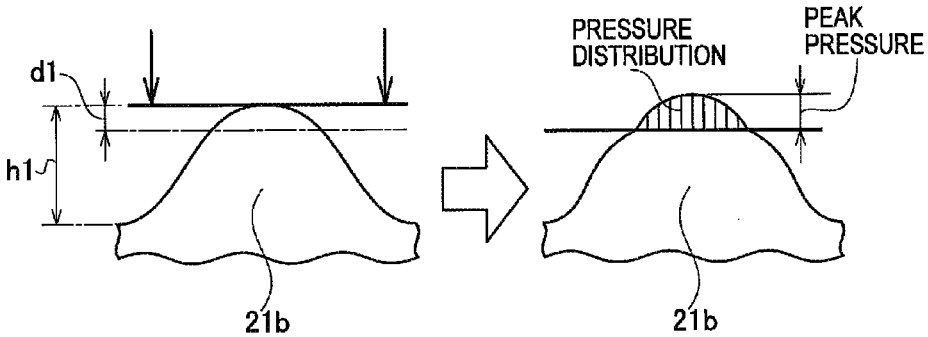
FIG. 3C is a view that explains the compression ratio of a lip in the connector according to the embodiment.

As illustrated in FIG. 3C, when the height in a state of a load not acting upon is denoted by h1 and the dimension shrunk by a load acting thereupon is denoted by d1, the compression ratio CR1 of the mat seal 21 (the compression ratio CR2 described below will also be the same) becomes CR1=d1/h1.

Figure 4A:
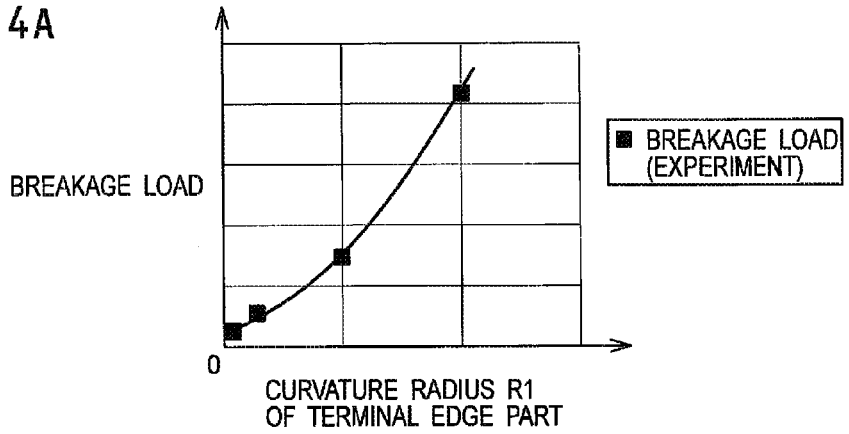
FIG. 4A is a measured view illustrating the relationship between a curvature radius of a terminal edge part and a breakage load of the connector according to the embodiment.
Figure 4B:
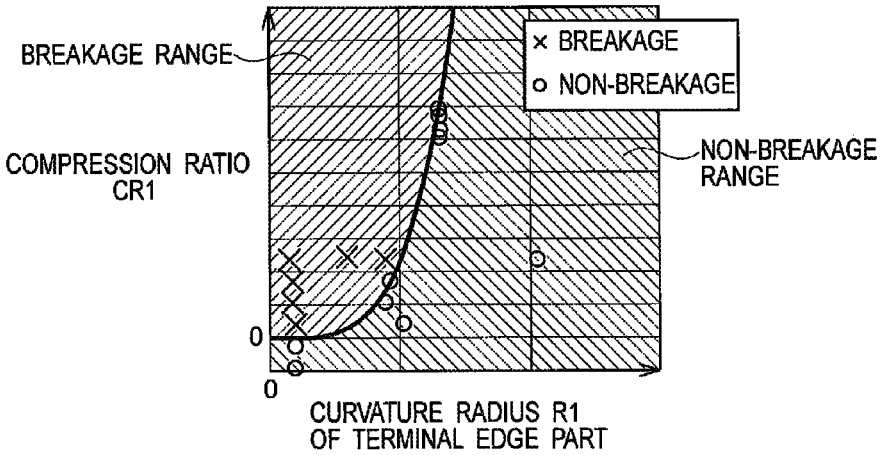
FIG. 4B is a measured view (with virtual characteristic line) illustrating the relationship between a curvature radius of a terminal edge part and a compression ratio in the connector according to the embodiment.

In other words, as illustrated in FIG. 4A, when the curvature radius R1 of the edge parts 3*a*, 3*c*, and 3*d* of the cylindrical body 3 is made larger, it becomes more difficult for the mat seal 21 to break (the breakage load becomes higher), and when the compression ratio CR1 of the mat seal 21 is made smaller, it becomes more difficult to break (the breakage load becomes higher). Further, as illustrated in FIG. 4B, it was confirmed by experiments that a range that the breakage damage occurs and a range that the breakage damage does not occur can be divided by using the curvature radius R1 of the edge parts 3*a,* 3*c,* and 3*d* of the cylindrical body 3 and the compression ratio CR1 of the mat seal 21 as parameters. Therefore, the mat seal 21 can be made as one that does not break (that does not become damaged by breakage) at the time of terminal penetration if the curvature radius R1 and the compression ratio CR1 are set in a range that the breakage damage does not occur.

Moreover, when the curvature radius on the tip side of the lip 21*b* is denoted by R2, and the compression ratio of the lip 21*b* in a state that the electric wire W is arranged in the wire insertion hole 21*a* (the state of FIG. 3B) is denoted by CR2, a formula (2) of the sealing property of the mat seal 21=f(CR2×number of lips/R2) is established.

Figure 4C:
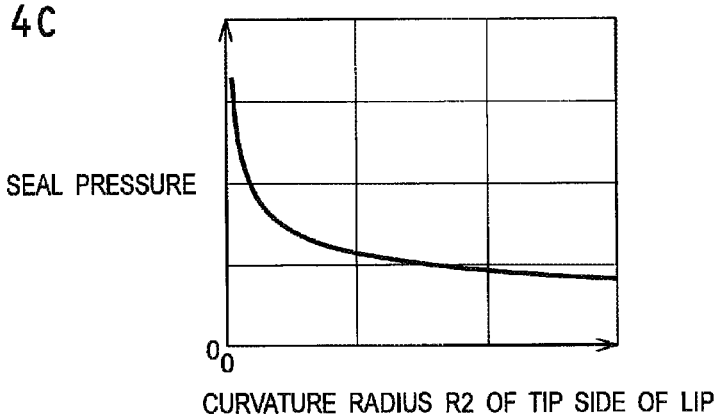
FIG. 4C is a characteristic line view illustrating the relationship between a curvature radius of a tip side of the lip of the sealing member and a sealing pressure (sealing property) of the connector according to the embodiment.

In other words, the sealing property of the mat seal 21 depends on the sealing pressure, and the sealing property becomes higher when the compression ratio CR2 becomes higher. Further, as illustrated in FIG. 4C, when the curvature radius R2 on the tip side of the lip 21*b* becomes smaller, the sealing property of the mat seal 21 becomes higher. To be specific, as illustrated in FIG. 3C, the sealing property depends on the magnitude of the peak pressure within the sealing pressure. Further, the sealing property becomes higher when the number of lips 21*b* is increased (in the following, for the sake of simplicity, explanations regarding the number of lips 21*b* will be omitted). Thus, according to the formula (2), the mat seal 21 can be made as one having a desired sealing property at the time of press-fitting of the electric wire if the curvature radius R2 and the compression ratio CR2 with which a desired sealing property (sealing pressure) can be obtained are set.

Here, the compression ratio CR1 is determined by the outside dimension of the cylindrical body 3 of the terminal 1 and the inner diameter at the tip position of the lip 21*b* of the wire insertion hole 21*a* of the mat seal 21 (hereinafter, the smallest inner diameter of the wire insertion hole 21*a*). The compression ratio CR2 is determined by the outer diameter of the electric wire W and the smallest inner diameter of the wire insertion hole 21*a* of the mat seal 21. In other words, the compression ratio CR1 and the compression ratio CR2 are values that are not mutually independent but are values that are mutually related.

Figure 5:
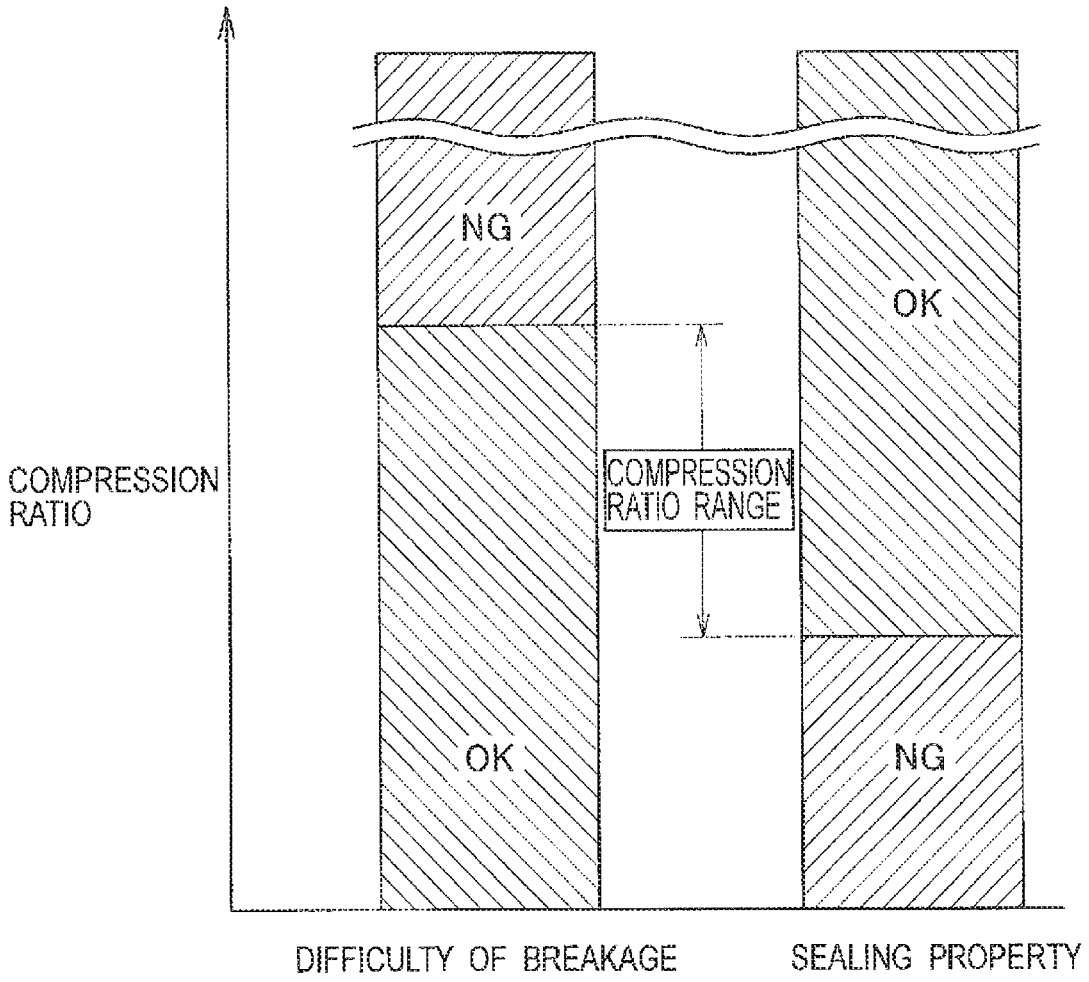
FIG. 5 is a view illustrating a range of compression ratios that satisfy both the compression ratio at the time of terminal penetration into the sealing member (the difficulty of breakage property) and the compression ratio at the time of press fitting of the electric wire in the sealing member (the sealing property) in the connector according to the embodiment.

Accordingly, as illustrated in FIG. 5, the above-described compression ratio CR1 and compression ratio CR2 are determined in a range that satisfies both the permissible range (an OK range) for the compression ratio CR1 of the lip 21*b* at the time of terminal penetration (the difficulty of breakage property) and the permissible range (an OK range) for the compression ratio CR2 of the lip 21*b* at the time of press-fitting of the electric wire (the sealing property). Then, based on a value of the thus determined compression ratio CR1, a value of the above-described curvature radius R1 is set, and based on a value of the determined compression ratio CR2, the above-described curvature radius R2 is set.

In the above structure, the terminal 1 to which the electric wire W is connected is inserted from the mat seal housing 20*b* that opens at the rear face of the connector housing 20. Then, the terminal 1 enters the wire insertion hole 21*a* of the mat seal 21 via the electric wire hole 22*a* of the rear holder 22. At the time when the terminal 1 passes through the wire insertion hole 21*a* of the mat seal 21, the cylindrical body 3 of the terminal 1 advances while stretching out the wire insertion hole 21*a,* and the terminal 1 is set in the terminal housing 20*a*. For the above-described reasons, in the process of the terminal 1 penetrating into the mat seal 21, the mat seal 21 does not break (become breakage damaged).

In a state that the terminal 1 is inserted in the terminal housing 20*a,* the electric wire W that is connected to the terminal is arranged in the wire insertion hole 21*a* of the mat seal 21. For the above-described reasons, the electric wire W is arranged in a state that it receives a desired sealing pressure from the mat seal 21, and a desired sealing property (waterproof property) is secured. Thus, in a connector in which the terminal 1 is mounted by passing through the wire insertion hole 21*a* of the mat seal 21, damage (breakage damage) to the mat seal 21 can be prevented while a desired sealing property (waterproof property) is secured.

In the connector according to the embodiment, the curvature radius R1 and the curvature radius R2 are set in the range of the compression ratios that satisfies both the permissible range for the compression ratio CR1 and the permissible range for the compression ratio CR2 (see FIG. 5). Therefore, prevention of damage (breakage damage) to the mat seal 21 in a penetration process of the terminal 1 and securing of the sealing property of the mat seal 21 in a state of press-fitting the electric wire W can be achieved securely.

In the connector according to the embodiment, from the formula (1), by making the curvature radius R1 of the edge parts 3*a,* 3*c,* and 3*d* of the cylindrical body 3 higher, the allowable maximum value for the compression ratio CR1 of the mat seal 21 (the boundary value between NG and OK of the difficulty of breakage in FIG. 5) can be made variable, and thus, the degree of freedom in designing can be enhanced.

In the connector according to the embodiment, from the formula (2), by making the curvature radius R2 on the tip side of the lip 21*b* smaller, the allowable minimum value for the compression ratio CR2 of the lip 21*b* of the mat seal 21 (the boundary value between OK and NG of the sealing property in FIG. 5) can be made variable, and thus, the degree of freedom in designing can be enhanced.

Next, each modification of the terminal 1 will be explained. In each modification also, similarly to the above-described embodiment, the edge parts of the cylindrical body 3 that have a possibility of contacting the mat seal 21 in a process of passing through the wire insertion hole 21*a* of the mat seal 21 are all set to have the above-described curvature radius R1. In each modification, the edge parts are the end face 3*d* that becomes the insertion tip of the cylindrical body 3 toward the mat seal 21 and the corners 3*c* due to bending of the plate material (more specifically, their outer peripheral surfaces), and do not include the end face 3*a* of the plate material that extends in the insertion direction (relative insertion direction with a mating terminal) D toward the mat seal 21.

(First Modification of Terminal)

Figure 6A:
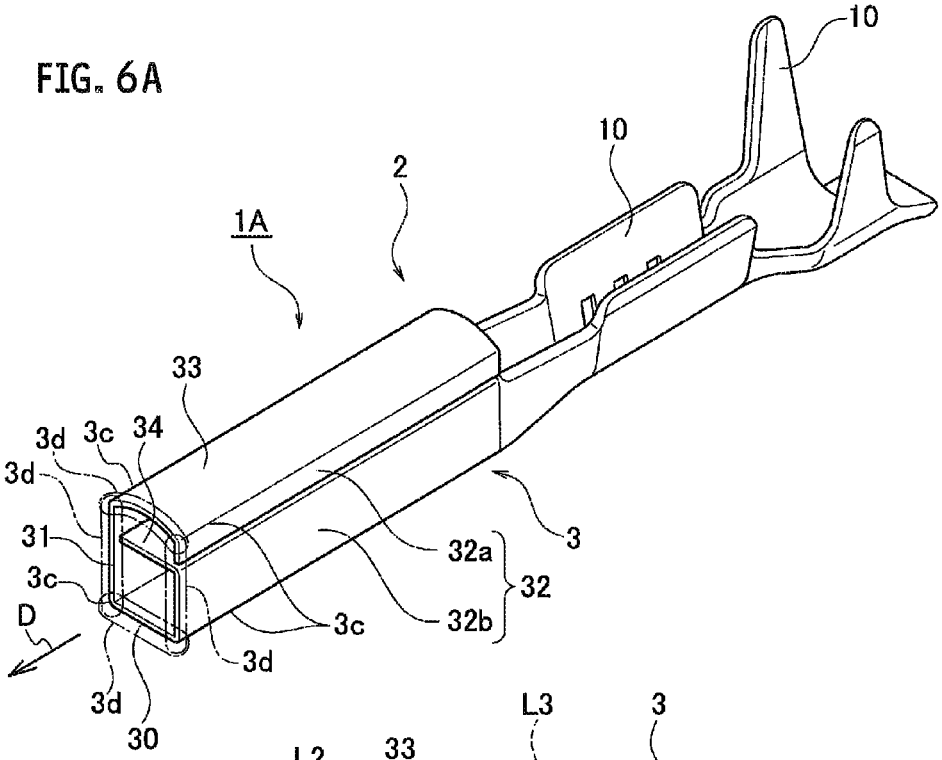
FIG. 6A is a perspective view of a terminal according to a first modification.
Figure 6B:
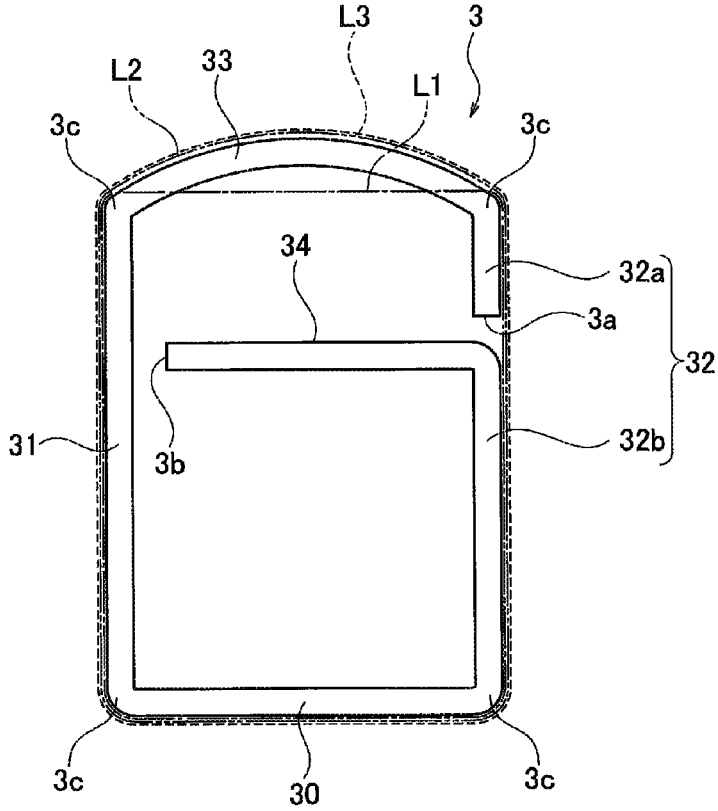
FIG. 6B is a front view of the terminal on the insertion tip side to the sealing member according to the first modification.

FIG. 6 illustrates a terminal 1A according to a first modification. The terminal 1A according to the first modification is formed by bending a sheet of conductive plate material that is formed in a predetermined shape. The terminal 1A includes a mating terminal connecting section 2 to which a mating terminal (not illustrated) is to be electrically connected, and an electric wire connecting section 10 to which the electric wire W is connected.

The mating terminal connecting section 2 includes a cylindrical body 3 having a rectangular shape and an elastic contact part (not illustrated) arranged within the cylindrical body 3. The cylindrical body 3 together with the elastic contact part is formed into a cylindrical shape by bending a sheet of plate material at a plurality of places.

More specifically, the cylindrical body 3 includes a bottom part 30, a first side part 31 that is bent from one end of the bottom part 30 and extends vertically, a top part 33 that is bent from the upper end of the first side part 31, an upper second side part 32*a* that is bent from one end of the top part 33, a lower second side part 32*b* that is bent from the other end of the bottom part 30 and extends vertically, and an inner top part 34 that is bent inward from the upper end of the lower second side part 32*b* and extends horizontally.

The top part 33 is made to have an arc shape that protrudes upward at the center.

A second side part 32 is formed by the upper second side part 32*a* and the lower second side part 32*b*. The lower end of the upper second side part 32*a* is one end face 3*a* of the plate material that extends in the insertion direction (relative insertion direction with a mating terminal) D toward the mat seal 21, and the end face 3*a* is arranged close to the upper end of the lower second side part 32*b*. The tip of the inner top part 34 is the other end face 3*b* of the plate material that extends in the insertion direction (relative insertion direction with a mating terminal) D toward the mat seal 21.

In the cylindrical body 3 thus constructed, when forming an imaginary contour line L3 giving priority to a contour line located outside if one exists in a segment between a contour line L1 that connects the adjacent corners 3*c* of the cylindrical shape and an actual contour line L2 of the cylindrical shape (in the first modification, the actual contour line L2=the imaginary contour line L3), the end faces 3*a*, 3*b* of the plate material that extends in the insertion direction (relative insertion direction with a mating terminal) D toward the mat seal 21 are located inward (within the limits) of this imaginary contour line L3. More specifically, the one end face 3*a* is located at a position between the adjacent comers 3*c* and at a position that follows the imaginary contour line L3. The other end face 3*b* is located at a position that enters inward of the imaginary contour line L3 since it is located inside of the cylindrical body 3.

The elastic contact part (not illustrated) is provided for example to extend from the bottom part 30, and has a plate spring (not illustrated) arranged by bending inside the cylindrical body 3, and a mating terminal that is inserted between the plate spring (not illustrated) and the inner top part 34 is pressure-contacted by the contact pressure of the elastic return force of the plate spring (not illustrated).

In the above structure, the terminal 1A to which the electric wire W is connected is inserted from the mat seal housing 20*b* that opens at the rear face of the connector housing 20. Then, the terminal 1A enters the wire insertion hole 21*a* of the mat seal 21 via the electric wire hole 22*a* of the rear holder 22. At the time when the terminal 1A passes through the wire insertion hole 21*a* of the mat seal 21, the cylindrical. body 3 of the terminal 1A advances while stretching out the wire insertion hole 21*a*, but at that time, the end faces 3*a*, 3*b* of the plate material that extends in the insertion direction toward the mat seal 21 do not contact the inner wall surface of the wire insertion hole 21*a*. Further, while the corners 3*c* of the cylindrical body 3 of the terminal 1A apply external force to the mat seal 21 to stretch out the wire insertion hole 21*a* more strongly than the other places, a possibility of the corners 3*c* damaging the mat seal 21 is reduced since the end faces 3*a*, 3*b* of the plate material that extends in the insertion direction toward the mat seal 21 do not exist at the corners 3*c*. Thus, with the terminal 1A mounted on the connector housing 20 by passing through the wire insertion hole 21*a* of the mat seal 21, damage to the mat seal 21 can be prevented as much as possible.

(Second Modification of Terminal)

Figure 7A:
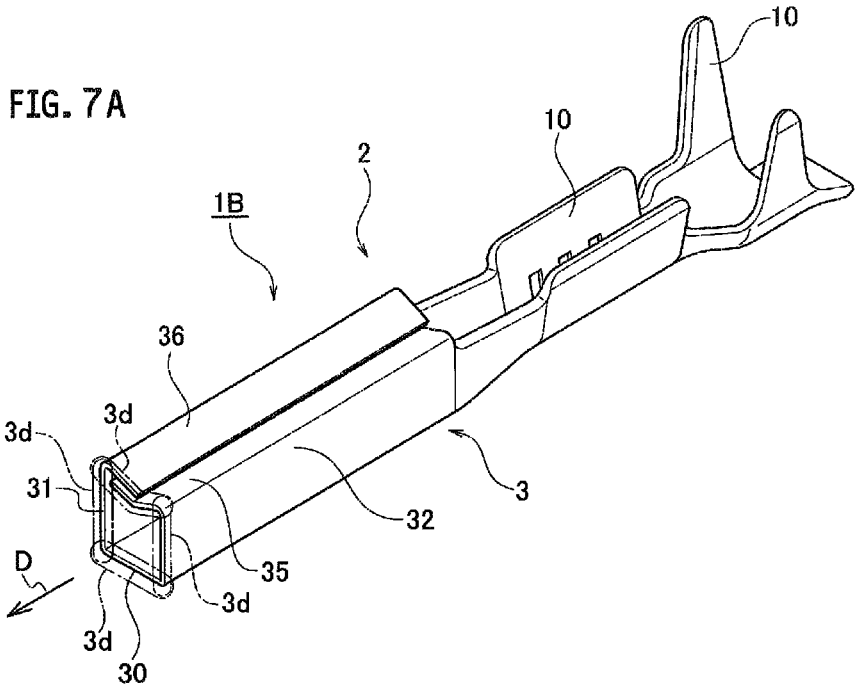
FIG. 7A is a perspective view of a terminal according to a second modification.
Figure 7B:
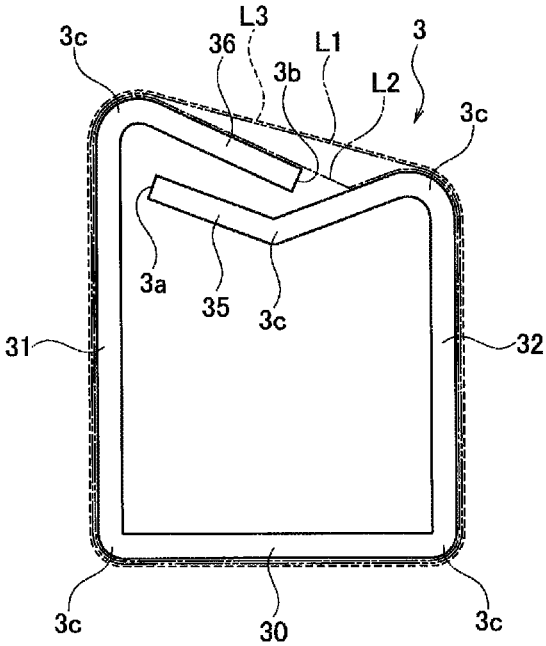
FIG. 7B is a front view of the terminal on the insertion tip side to the sealing member according to the second modification.

FIG. 7 illustrates a terminal 1B according to a second modification. The terminal 1B according to the second modification differs only in a structure of the cylindrical body 3 as compared with the terminal 1A according to the first modification. In other words, the cylindrical body 3 includes a bottom part 30, a first side part 31 that is bent from one end of the bottom part 30 and extends vertically, a second side part 32 that is bent from the other end of the bottom part 30 and extends vertically to be lower than the first side part 31, a first top part 35 that is bent from the upper end of the second side part 32, and a second top part 36 that is bent from the upper end of the first side part 31 and folds above the first top part 35. The first top part 35 is inclined downward relative to the horizontal direction and on the way it is inclined upward relative to the horizontal direction the other way around. The tip of the first top part 35 is one end face 3*a* of the plate material that extends in the insertion direction toward the mat seal 21. The second top part 36 is inclined downward relative to the horizontal direction. The tip of the second top part 36 is the other end face 3*b* of the plate material that extends in the insertion direction toward the mat seal 21. The end face 3*b* of the second top part 36 is located upward of the bent position of the first top part 35.

In the cylindrical body 3 thus constructed, when forming art imaginary contour line L3 giving priority to a contour line located outside in a case one exists between a contour line L1 that connects the adjacent corners 3*c* of the cylindrical shape and an actual contour line L2 of the cylindrical shape (in the second modification, the contour line L1=the imaginary contour line L3), the end faces 3*a*, 3*b* of the plate material that extends in the insertion direction (relative insertion direction with a mating terminal) D toward the mat seal 21 are located inward (within the limits) of the imaginary contour line L3. More specifically, the one end face 3*a* is located at a position that enters inward of the imaginary contour line L3 since it is located inside of the cylindrical body 3. The other end face 3*b* is located at a position between the adjacent corners 3*c* and at a position that enters inward of the imaginary contour line L3 even though it is exposed outside.

In the second modification also, similarly to the first modification, when the terminal 1B is inserted through the wire insertion hole 21*a* of the mat seal 21, damage to the mat seal 21 can be prevented as much as possible. In particular, since the other end face 3*b* of the plate material is located between the adjacent corners 3*c* and at a position that enters inward of the imaginary contour line L3, it is possible to securely prevent contacting the inner wall surface of the wire insertion hole 21*a* of the mat seal 21.

(Third Modification of Terminal)

Figure 8A:
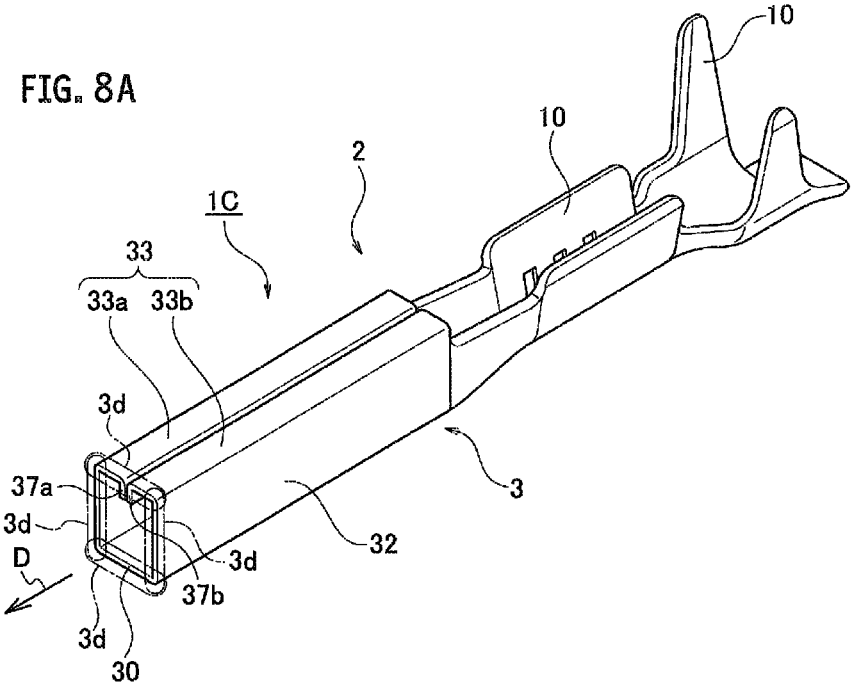
FIG. 8A is a perspective view of a terminal according to a third modification.
Figure 8B:
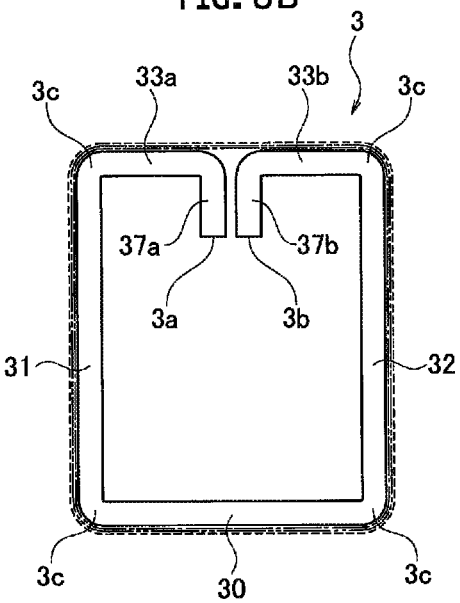
FIG. 8B is a front view of the terminal on the insertion tip side to the sealing member according to the third modification.

FIGS. 8A and 8B illustrate a terminal 1C according to the third modification. The terminal 1C according to the third modification differs only in a structure of the cylindrical body 3 as compared with the terminal 1A according to the first modification. In other words, the cylindrical body 3 includes a bottom part 30, a pair of side parts 31, 32 that are bent from both ends of the bottom part 30 and extend vertically, a pair of top parts 33*a*, 33*b* that are bent from the upper end of each side part 31, 32, and a pair of opposing parts 37*a*, 37*b* that are bent vertically downward from the positions of respective top part 33*a*, 33*b* that come close opposing to each other.

In the cylindrical body 3 thus constructed, when forming an imaginary contour line L3 giving priority to a contour line located outside in a case one exists between a contour line L1 that connects the adjacent corners 3*c* of the cylindrical shape and an actual contour line L2 of the cylindrical shape (in the third modification, the contour line L1=the actual contour line L2 =the imaginary contour line L3), the end faces 3*a*, 3*b* of the plate material that extends in the insertion direction (relative insertion direction with a mating terminal) D toward the mat seal 21 are located inward (within the limits) of the imaginary contour line L3. More specifically, both end faces 3*a*, 3*b* are located at a position between the adjacent corners 3*c* and at a position that enters inward of the imaginary contour line L3. Both end faces 3*a*, 3*b* are located inside of the cylindrical body 3.

In the third modification also, similarly to the first modification, when the terminal 1C is inserted through the wire insertion hole 21*a* of the mat seal 21, damage to the mat seal 21 can be prevented as much as possible. In particular, since both end faces 3*a*, 3*b* are located between the adjacent corners 3*c* and at a position that enters inward of the imaginary contour line L3, it is possible to securely prevent contacting the inner wall surface attic wire insertion hole 21*a* of the mat seal 21.

(Application Example of Third Modification of Terminal)

Figure 8C:
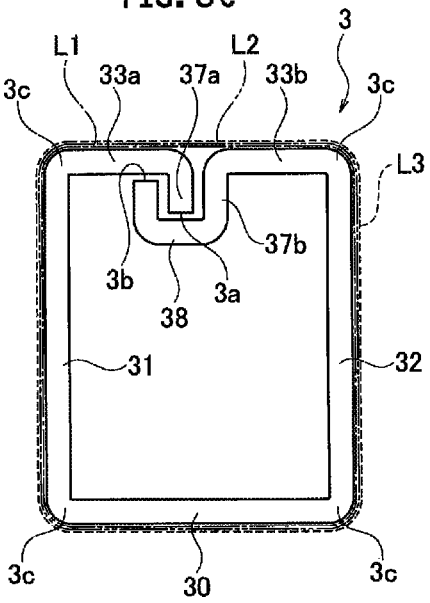
FIG. 8C is a front view of an application example of the terminal on the insertion tip side to the sealing member according to the third modification.
Figure 9:
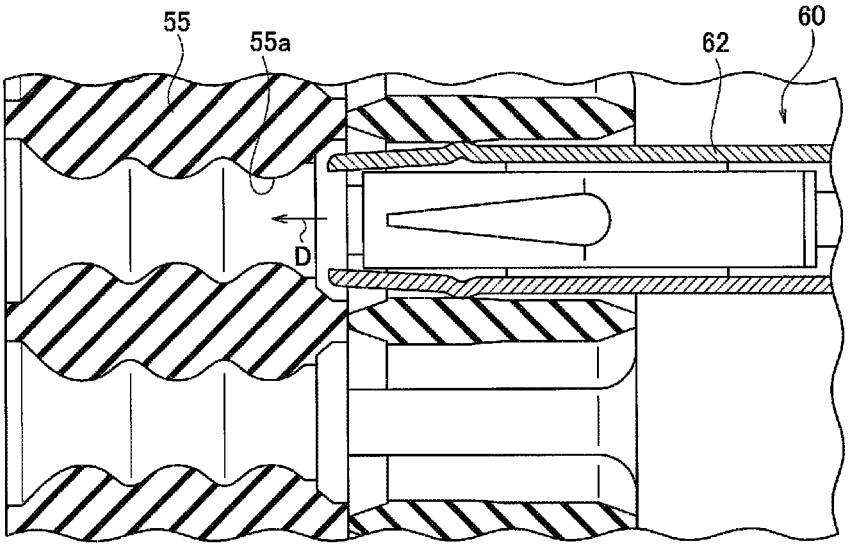
FIG. 9 PRIOR ART
FIG. 9 is a cross-sectional view illustrating a state in which a terminal passes through a sealing member of a connector according to a conventional example.
Figure 10A:
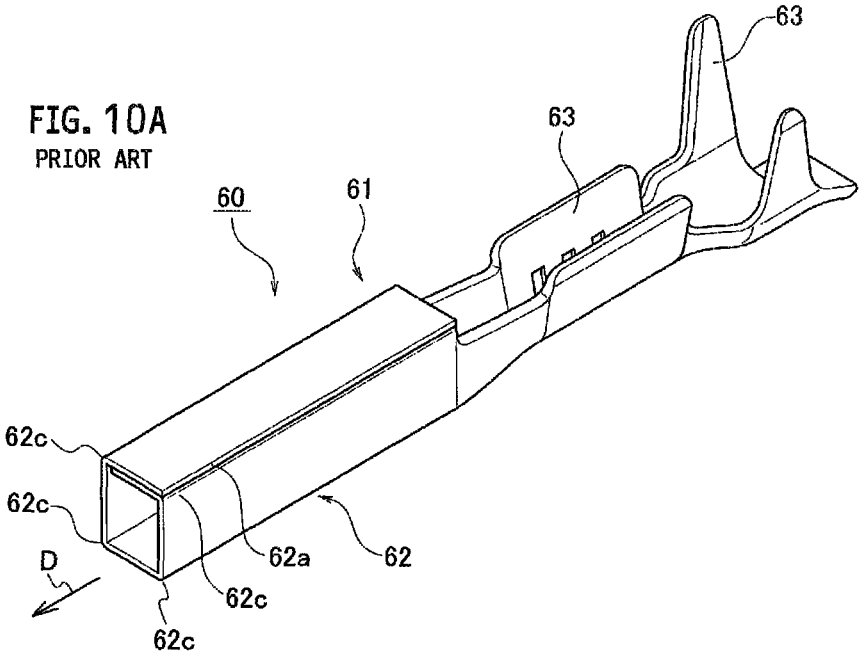
FIG. 10A PRIOR ART
FIG. 10A is a perspective view of a terminal of the connector according to the conventional example.
Figure 10B:
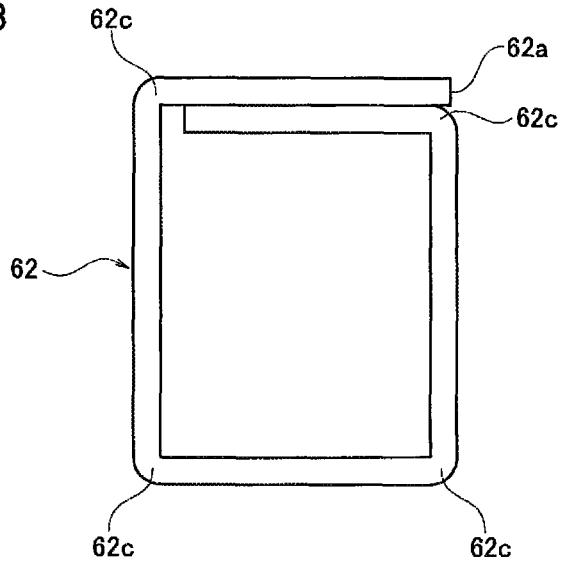
FIG. 10B PRIOR ART
FIG. 10B is a front view of the terminal that is the insertion tip side to the sealing member of the connector according to the conventional example.

FIG. 8C illustrates an application example of the third modification. The other opposing part 37*b* is formed longer than the one opposing part 37*a*, and this portion is made as a recessed locking part 38. Together with the other opposing part 37*b*, the locking part 38 surrounds the vicinity of the end face 3*a* of the one opposing part 37*a*. Since other structures are the same as those in the third modification, explanations will be omitted by attaching the same reference characters.

In the application example of the third modification also, similarly to the first modification, when the terminal is inserted through the wire insertion hole 21*a* of the mat seal 21, damage to the mat seal 21 can be prevented as much as possible. In particular, since both end faces 3*a*, 3*b* of the cylindrical body 3 are located between the adjacent corners 3*c* and at a position that enters inward of the imaginary contour line L3, it is possible to securely prevent contacting the inner wail surface of the wire insertion hole 21*a* of the mat seal 21.

Since the locking part 38 surrounds to sandwich the vicinity of the end face 3*a* of the one opposing face 37*a* together with the other opposing face 37*b*, it is possible to securely prevent displacement of the cylindrical body 3 in the opening direction.

What is claimed is:

1. A connector, comprising:

a sealing member having a wire insertion hole, an inner circumferential surface of the wire insertion hole being provided with a lip that protrudes; and a terminal to which an electric wire is connected, the terminal having a cylindrical body to which a mating terminal is inserted, wherein the terminal is accommodated in a position that passes through the wire insertion hole, the electric wire is arranged in a press-fitted state in the wire insertion hole, and in a condition in which the terminal passes through the wire insertion hole, a curvature radius of an edge part of the cylindrical body that contacts the inner circumferential surface of the wire insertion hole is denoted by R1 and a compression ratio of the lip of the sealing member is denoted by CR1, a breakage load is a function of the compression ratio CR1 and the curvature radius R1, and the compression ratio CR1 and the curvature radius R1 are set based on a formula of the breakage load =f (R1/CR1).

2. The connector according to claim 1, wherein:

in a condition in which a curvature radius on a tip side of the lip is denoted by R2 and a compression ratio of the sealing member in a state that the electric wire is arranged in the wire insertion hole is denoted by CR2, the compression ratio CR2 and the curvature radius R2 are set based on a formula of sealing property of the sealing material =f(CR2×number of lips/R2).

3. The connector according to claim 2, wherein:

the curvature radius R1 and the curvature radius R2 are set in a range of the compression ratios that satisfies both a permissible range for the compression ratio CR1 and a permissible range for the compression ratio CR2.

4. The connector according to claim 1, wherein the cylindrical body is formed into a cylindrical shape by bending a sheet of plate material at a plurality of places, the cylindrical body has an end face of the plate material, and in a condition in which an imaginary contour line is formed outside of a contour line located outside a contour segment that connects adjacent corners of the cylindrical shape and an actual contour line of the cylindrical shape, the end face is located inward of the imaginary contour line.

5. The connector according to claim 1, wherein the cylindrical body is formed into a cylindrical shape by bending a sheet of plate material at a plurality of places; and an end face of the plate material is located at a position between adjacent corners and at a position that follows an imaginary contour line that extends between the adjacent corners.

6. The connector according to claim 1, wherein the cylindrical body is formed into a cylindrical shape by bending a sheet of plate material at a plurality of places; and an end face of the plate material is located at a position between adjacent corners and at a position that enters inward of an imaginary contour line that extends between the adjacent corners or inside of the cylindrical body.

* * * * *